US006839533B2

(12) United States Patent
Ban et al.

(10) Patent No.: US 6,839,533 B2
(45) Date of Patent: Jan. 4, 2005

(54) DEVELOPER SUPPLY CONTAINER

(75) Inventors: Yutaka Ban, Tokyo (JP); Tetsuo Isomura, Abiko (JP); Hironori Minagawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/420,885

(22) Filed: Apr. 23, 2003

(65) Prior Publication Data

US 2003/0223782 A1 Dec. 4, 2003

(30) Foreign Application Priority Data

Apr. 25, 2002 (JP) ..... 2002-123618

(51) Int. Cl.[7] ..... G03G 15/08
(52) U.S. Cl. ..... 399/260; 399/120
(58) Field of Search ..... 399/260, 262, 399/258, 111, 120

(56) References Cited

U.S. PATENT DOCUMENTS 5,268,722 A 12/1993 Ikkatai et al. ..... 355/260
5,351,728 A 10/1994 Ban et al. ..... 141/364
5,579,101 A * 11/1996 Omata et al. ..... 399/11
6,289,193 B1 9/2001 Ban et al. ..... 399/258
6,438,345 B1 8/2002 Ban et al. ..... 399/262

FOREIGN PATENT DOCUMENTS

JP 2000-275944 10/2000

* cited by examiner

*Primary Examiner*—Quana Grainger
(74) *Attorney, Agent, or Firm*—Fitzpatrick, Cella, Harper & Scinto

(57) ABSTRACT

A developer supply container detachably mountable to an image forming apparatus, the developer supply container includes a main body for accommodating a developer; a discharge opening, provided in the main body, for permitting discharge of the developer; a shutter member for opening and closing the discharge opening; a rotatable member which is rotatable relative to the main body to effect opening and closing movement of the shutter member; a regulating member for limiting a rotation of the rotatable member in a direction of opening the shutter member, wherein the regulating member includes an extended portion integral with the rotatable member and extended substantially along the opening rotational direction of the rotatable member and a limiting projection, projected from the extended portion toward the main assembly, for abutment to a stopper projection of the main body, wherein the regulating member has an abutting portion for abutment to an image forming apparatus in a mounting operation of the developer supply container, and the limiting projection displaces to a position where it is incapable of abutting the stopper projection.

11 Claims, 10 Drawing Sheets

DEVELOPER SUPPLY CONTAINER

FIELD OF THE INVENTION AND RELATED ART

The present invention relates to developer supply container, detachably mountable to an image forming apparatus, for supplying a developer, the image forming apparatus may be of an electrophotographic type or electrostatic recording type, such as a copying machine, a printer, a facsimile machine or the like.

Conventionally, the image forming apparatus such as an electrophotographic copying machine or printer, a developer in the form of fine particles is used. When the developer in the main assembly of the image forming apparatus is used up, the developer is supplied into the image forming apparatus, using a developer container.

The developer container for supplying the developer into the image forming apparatus is generally classified into two groups, namely, an all-together type wherein all amount of the developer accommodated in the developer container is supplied all together into a developer receiving portion of the image forming apparatus, and a stationary type which is set into the main assembly of the image forming apparatus and is kept there. The stationary type container gradually supplies the developer therefrom into the developing device until it is used up.

It is a recent trend to use the stationary type because of the demand for downsizing of the image forming apparatus. In order to prevent scattering of the developer remaining in the container out of the discharge opening when the developer container is exchanged, an openable member for sealing the discharge opening is provided.

In an example of opening and closing of the container by the openable member, the, following is proposed in an application assigned to the assignee of this application. That is, a rotatable member is rotatably engaged with the main body of the developer container, and the rotational driving force of the rotatable member is transmitted through a drive transmission member provided in the main assembly of the image forming apparatus to the openable member for opening and closing the developer discharge opening.

In the state that developer container is set in the main assembly of the image forming apparatus, the position of the rotatable member relative to the openable member is fixed, and when the developer container is taken out of the main assembly of the image forming apparatus, the rotatable member is released from the openable member and becomes rotatable.

The gear portion provided on the rotatable member is not extended all around but is extended partly into a form of sector gear (arcuate) since then the space can be saved. Therefore, since the gear portion is not engaged with a gear of a drive transmission member of the main assembly of the image forming apparatus and since the openable member is moved between the sealing and opening position for the developer discharge opening by driving the gear within a limited range, the positional relation between the gear portion of the rotatable member at the time of supplying the developer and the gear portion of the main assembly of the image forming apparatus are limited, and locking means for preventing erroneous rotation of the rotatable member is required.

Japanese Laid-open Patent Application 2000-275944 which has been assigned to the assignee of this application proposes a developer container having a rotatable member in which there is provided locking means which is not rotatable except for the developer supply operation and which can be released when the developer container is mounted in the main assembly of the apparatus, and also proposes a locking member therefor.

Japanese Laid-open Patent Application No.2000-275944 further proposes a developer container including a ring-shaped locking member which is reciprocable in the mounting direction of the container and is urged in a locking direction (the same as the mounting direction of the container). By the mounting operation to the image forming apparatus, the ring-shaped locking member is movement in a releasing locking against the urging force.

With such a structure, there is provided locking member in addition to the shutter rotatable member which is an opening and closing member for the main body of the developer container with the result of relatively large number of parts and therefore a large number of assembling steps and a higher manufacturing cost. In the manufacturing step, there is a liability of inadvertent failure of assembling the locking member, and therefore, an additional inspection step is required.

The ring-shaped locking member is constituted such that it is contained in the rotatable member, but a space is still required to permit motion in the mounting direction, against the desire for the downsizing of the developer container and therefore the image forming apparatus.

In order to move stably the ring-shaped locking member, a plurality of release portion are arranged in the circumferential direction of the rotatable member to reduce an offset load which is influential when the locking member makes a relative movement in the mounting direction. If only one release portion is provided, the locking member may become oblique to such an extent as to prevent the motion.

When the plurality of the release portions are provided, the main assembly of the image forming apparatus has to be provided with a corresponding number of engaging portions for operating the release portion. However, this is not desirable from the standpoint of downsizing of the image forming apparatus, and it is particularly so in the type of the apparatus in which developer containers are carried on a rotary type developing device.

SUMMARY OF THE INVENTION

Accordingly, it is a principal object of the present invention to provide a developer supply container with which rotation of a rotatable member is limited by a simple structure.

It is another object of the present invention to provide a developer supply container wherein rotation regulation release of the rotatable member can be effectively prevented even when the rotatable member is rotated in the opening direction.

It is a further object of the present invention to provide a developer supply container wherein creep deformation of the regulating member can be prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

The preferred embodiments of the present invention will be described in conjunction with the accompanying drawings.

Figure 1:
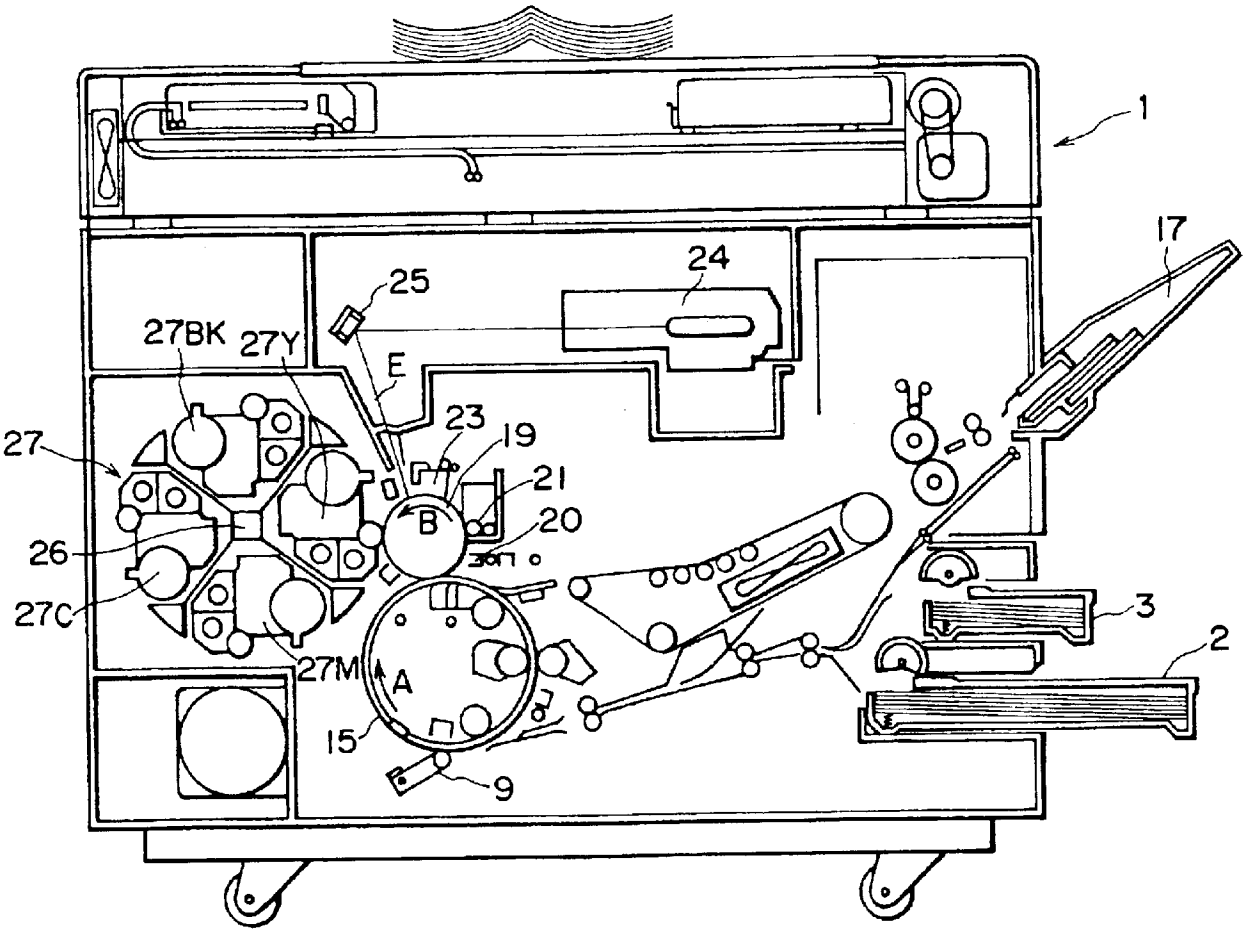
FIG. 1 is a schematic sectional view of an image forming apparatus usable with a developer container according to an embodiment of the present invention.
Figure 2:
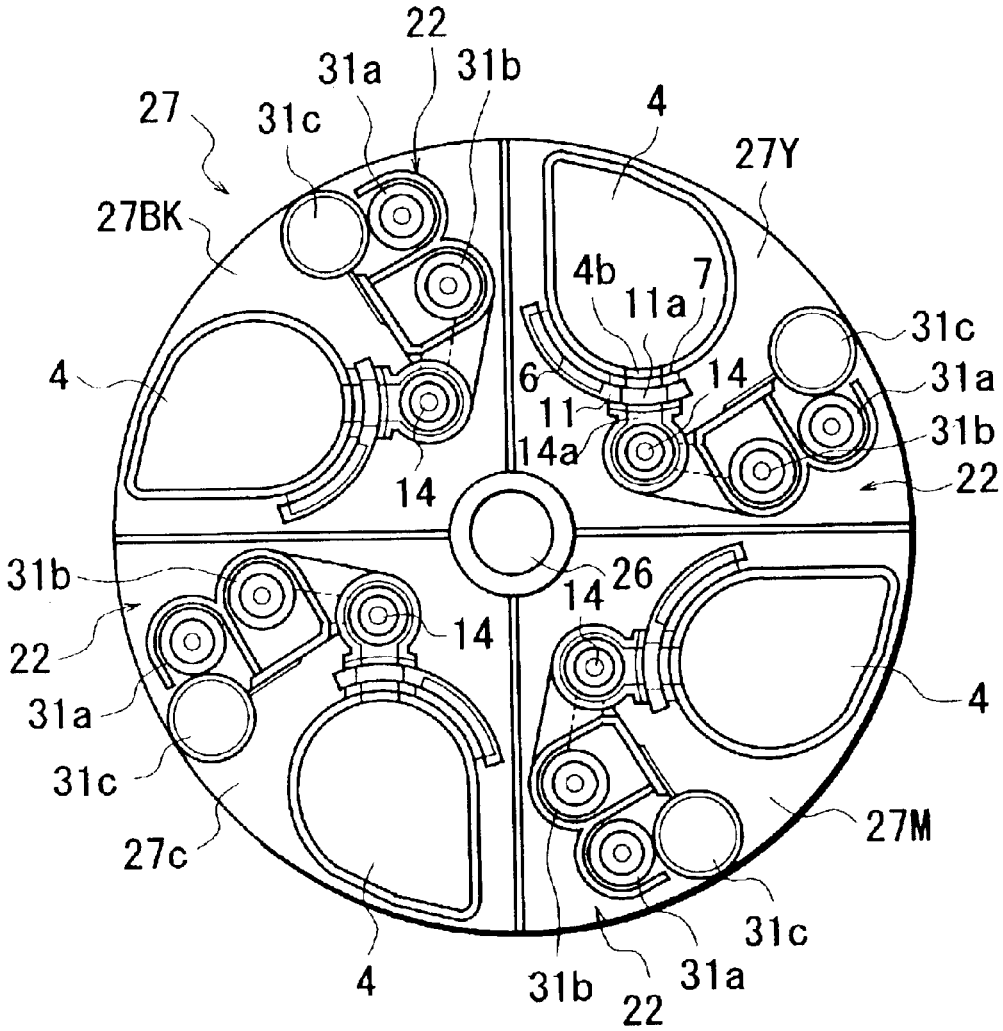
FIG. 2 is a schematic sectional view of a rotary type developing device.
Figure 3:
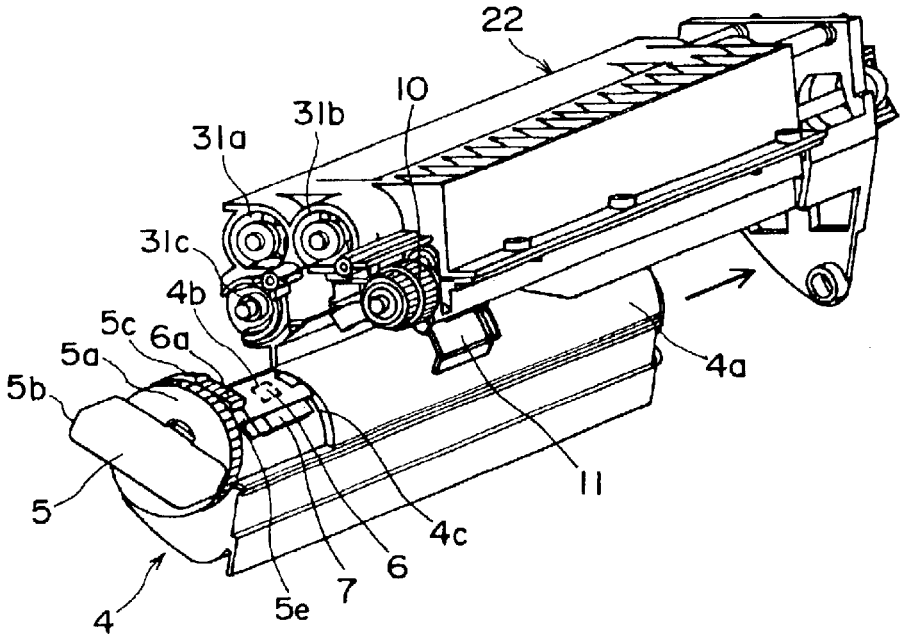
FIG. 3 is a schematic perspective view illustrating the developer container to a developing device.
Figure 4:
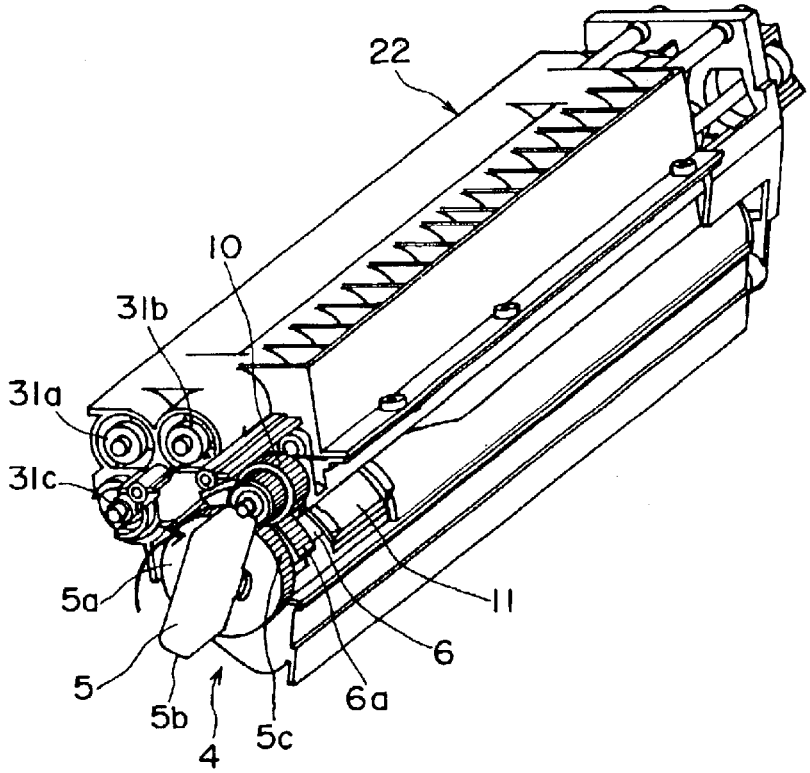
FIG. 4 is a schematic perspective view of a developer container mounted to a developing device.
Figure 5:
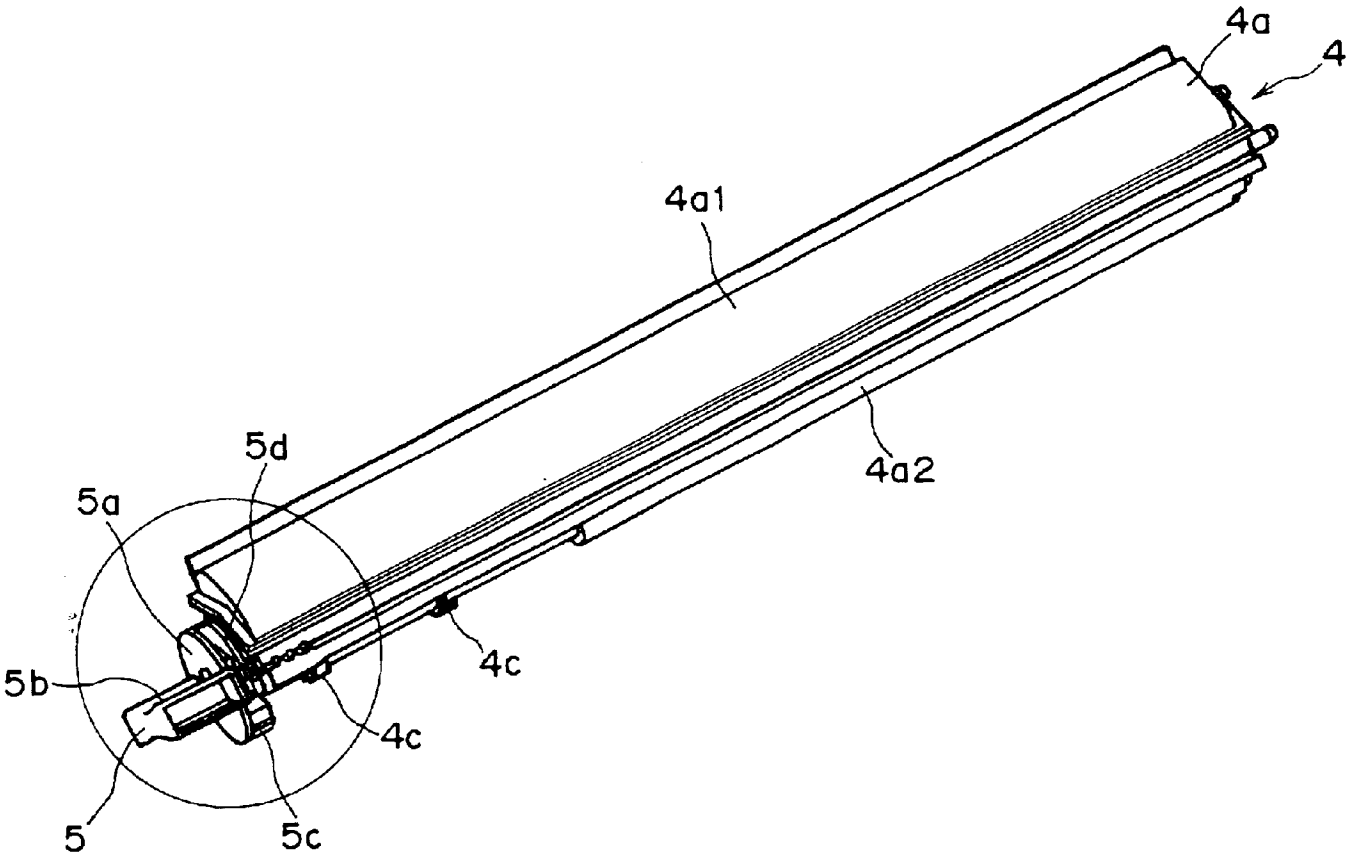
FIG. 5 is a schematic perspective view of a developer container according to a first embodiment of the present invention.
Figure 6:
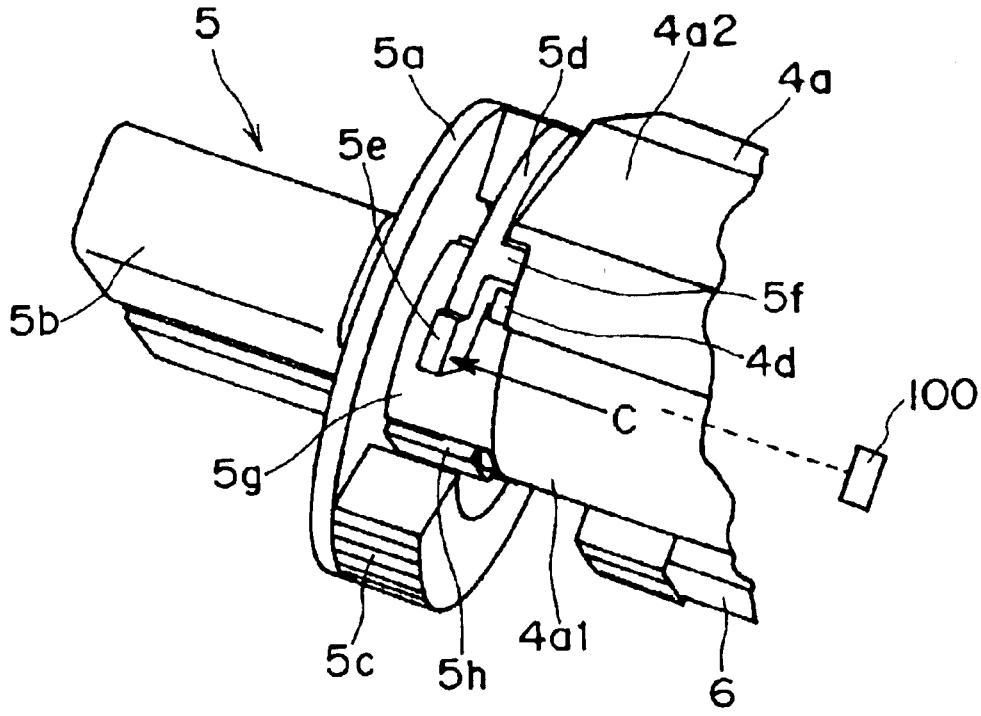
FIG. 6 is an enlarged view of a developer container according to the first embodiment of the present invention.

FIG. 1 is a schematic sectional view of an image forming apparatus usable with a developer container according to an embodiment of the present invention: FIG. 2 is a schematic sectional view of a rotary type developing device: FIG. 3 is a schematic perspective view illustrating the developer container to a developing device: FIG. 4 is a schematic perspective view of a developer container mounted to a developing device; FIG. 5 is a schematic perspective view of a developer container according to a first embodiment of the present invention; FIG. 6 is an enlarged view of a developer container according to the first embodiment of the present invention: and FIGS. 7(*a*) through 7(*c*) are side views illustrating engagement between a locking portion of a rotatable member and a portion to be locked of a main body of a developer container.

Referring to FIG. 1–FIGS. 7(*a*) through 7(*c*), and description will first be made as to an image forming apparatus of a first embodiment usable with a developer container according to an embodiment of the present invention. The image forming apparatus 1 to which the developer container according to an embodiment of the present invention is mountable, comprises image forming means including a photosensitive drum 19 (latent image forming station). An outer surface of the photosensitive drum 19 is contacted to a transfer drum 15, and the photosensitive drum 19 is rotatable in a direction indicated by arrow B in FIG. 1

Around the outer surface of the photosensitive drum 19, there are provided a discharging charger 20, cleaning means 21 and a primary charger 23 in the order named in the rotational direction of the photosensitive drum 19. There are also provided image exposure means 24 in the form of a laser beam scanner for example for forming an electrostatic latent image on the outer surface of the photosensitive drum 19, and image exposure reflecting means 25 such as a mirror.

Adjacent a latent image forming station, a rotary type developing device 27 (developing means) is provided. As shown in FIG. 2, the rotary type developing device 27 includes a rotatable member 26 (casing or frame) which is rotatable and is so disposed as to oppose to the outer surface of the photosensitive drum 19. The rotatable member 26 contains four developing devices 27 at equally divided positions along the circumferential direction thereof. The developing devices 27 functions to visualize the electrostatic latent images formed on the outer surface of the photosensitive drum 19, respectively.

The developing devices 27 include a yellow developing device 27Y, a magenta developing device 27M, a cyan developing device 27C and a black developing device 27BK. The four developing devices 27 can selectively be brought to a developing position, where the selected developing device is contacted to the photosensitive drum 19 and is capable of effecting the developing operation. In the Figure, yellow developing device 27Y is situated at the developing position where is contacted to the photosensitive drum 19. Thus, the developing devices 27 can develop the latent images with the respective colors.

The developing device 27 have the same structures, and as shown in FIG. 2, it comprises a developer container 4, a developer receiving portion 14 for receiving the developer discharged from the developer container 4, and a developing device 22 for developing the electrostatic latent image formed on the photosensitive drum 19 with the developer supplied from the developer receiving portion 14.

The developer receiving portion 14 receives the developer discharged from the developer container 4 and stores it. In accordance with the request from the developing device 22, it supplies a predetermined amount of the developer into the developing device 22.

In the developing device 22, there are provided screws 31*a*, 31*b* (developer feeding members) having opposite feeding directions. They function to circulate the toner of the carrier of the developer into a uniform mixture.

The developing device 22 further includes a rotatable developing sleeve 31*c* containing herein a magnet. It attracts the carrier particles by the magnetic force to form a magnetic brush, and the toner attracted to the carrier is supplied to the photosensitive drum 19.

The surface of the photosensitive drum 19 uniformly charged by the primary charger 23 is exposed to laser beam E in accordance with the image information by the image exposure means 24 so that electrostatic latent image is formed. The electrostatic latent image is developed by the corresponding one of the developing device 27 into a toner image. The toner image formed on the surface of the photosensitive drum 19 is temporarily transferred (primary transfer) onto the surface of the transfer drum 15 which is rotated in the direction indicated by arrow An in FIG. 1.

On the other hand, a recording sheet fed from a sheet cassette 2 or 3 or manual feeding tray 17 by sheet feeding means is fed to between the transfer drum 15 and the secondary transfer charger 9, and the toner image having been transferred onto the transfer drum 15 is re-transferred onto the recording sheet by operation of the secondary transfer charger 9.

Thereafter, the recording material is heated and pressed in a fixing device, so that toner image is fixed thereof into a permanent image, and is then discharged to an outside of the apparatus.

Referring to FIG. 2–FIG. 6, the details of the structure of the developer container according to an embodiment of the present invention will be described. In FIG. 2–FIG. 6, designated by a reference numeral 4 is a developer container for supplying the developer into the image forming apparatus 1, a developer accommodating portion 4*a* which is a main body of the developer container 4 contains the developer. Designated by 5 is a knob (rotatable member) rotatably mounted on the developer accommodating portion 4*a*, as shown in FIG. 2, the developer accommodating portion 4*a* is provided with a discharge opening 4*b* for discharging a developer contained in the developer accommodating portion 4*a*.

Decimated by 6 is a container shutter for unsealably sealing the discharge opening 4*b* provided on the developer accommodating portion 4*a*, and designated by 7 is a gasket provided around the discharge opening 4*b*.

(Developer Accommodating Portion)

Referring to FIG. 3–FIG. 5, the developer accommodating portion 4*a* which is the main body of the developer container 4 is in the formal a hollow cylinder. A discharge opening 4*b* for discharging the developer is provided in a peripheral surface adjacent one axial end, and the discharge opening 4*b* is substantially hermetically sealed by the container shutter 6 and the gasket 7. In this embodiment, the length of the developer accommodating portion 4*a* measured in the axial direction is not less than 1.5 times and not more than 6 times the diameter thereof. The discharge opening 4*b* is substantially rectangular.

The developer accommodating portion 4*a* which is the main body of the developer container 4 may be produced through an injection molding, a blow molding, an injection blow molding or the like of plastic resin material. In this embodiment, the developer accommodating portion 4*a*, as shown in FIG. 5, comprises an upper member 4*a*1 and a lower member 4*a*2, both of which are produced through an injection molding of shock-resistant polystyrene. They are then welded together by ultrasonic welding, thus providing a developer accommodating portion 4*a*. Another material or another manufacturing method is usable.

The container shutter 6 (sealing member) is preferably manufactured through injection molding of plastic resin material, but another material or manufacturing method is usable. The material of the container shutter 6 preferably has a rigidity and a slidability. In this embodiment, the material was ABS (acrylonitrile-butadiene-styrene copolymer resin material) resin material.

In this embodiment, the developer accommodating portion 4*a* is constituted by two parts, but it may be constituted by three or more parts which are unified into the developer accommodating portion 4*a*. Alternatively, it may be integrally produced through a blow molding or the like.

In the developer accommodating portion 4*a*, there is provided developer feeding means for feeding the developer the discharge opening 4*b*. The developer feeding means may be a rotatable stirring member including a rotatable shaft and a flexible blades, a helical projection on an inner wall of the developer accommodating portion 4*a* in which case the developer is fed by rotation of the developer container 4, or another known type.

(Rotatable Member)

At a front side of the apparatus of the developer accommodating portion 4*a*, a knob 5 is rotatably mounted. The knob 5 has a disk-like flange portion 5*a* and a tag portion 5*b* projecting frontwarldly from the flange portion 5*a*. The tag portion 5*b* facilitates mounting and demounting of the developer container 4 relative to the main assembly of apparatus by the operator, and by rotating the knob 5, the container shutter is opened or closed.

On the outer periphery of a portion 5*a* of the flange portion 2*a*, there is provided an arcuate segment gear 5*c*. Therefore, only a part of the full-circumference is provided with the gear teeth, which functions as a drive transmission side engaging portion. At a developer accommodating portion 4*a* of the portion 5*a* of the flange portion 2*a*, there is provided arcuate arm portion 5*d* extending along the rotational direction (in the direction of opening of the container shutter) of the knob 5, the arm portion 5*d* functioning as a locking portion. The arm portion 5*d* is integral with the knob 5.

(Container Shutter)

The container shutter 6 is arcuate extending along the outer surface of the developer accommodating portion 4*a*, and is provided with a guide portion having a channel-shaped cross-section (not shown) at each of the end portions. It is engaged with two parallel ribs 4*c* extending in the circumferential direction adjacent the discharge opening 4*b* of the developer accommodating portion 4*a* so that it is reciprocable in the circumferential direction of the developer accommodating portion 4*a*.

At the side of the developer accommodating portion 4*a* opposed to the container shutter 6, there is provided a gasket 7 so that discharge opening 4*b* is substantially hermetically sealed by compressing the gasket 7 by the container shutter 6. The container shutter 6 is also provided with a segment gear 6*a* which functions as a rotating force receiving portion.

(Mounting to Image Forming Apparatus)

(Operational State)

Referring to FIG. 2, the description will be made as to an operational state of the developer container 4 and the developing device 27. When the developer container 4 is unsealed, and the image forming apparatus 1 starts the image formation, the toner in the developing device 22 is gradually consumed. When detecting means for detecting an amount of the toner in the developing device 22 or a ratio of the toner and the carrier produces a signal, the developer feeding members 31*a*, 31*b* (the screw in FIG. 2 in this embodiment) in the developer receiving portion 14 rotates for a predetermined period of time to feed the developer into the developing device 22. By doing so, the ratio of the toner to the carrier or the amount of the toner in the developing device 22 is maintained at a substantially constant level.

By the rotation of the rotary type developing device 27, the developer in the developer container 4 is fed in the direction of the rotational axis and is discharged through the discharge opening 4*b* so that developer is supplied into the developer receiving portion 14.

In this manner, with the image forming operation, the developer in the developer container 4 is consumed. At a certain point of time, it is detected that emptiness of the developer container 4 is detected by developer amount detecting means, and the operator is prompted to exchange the developer container 4 by a display on an operation panel or the like.

(Mounting and Demounting of Developer Container)

Referring to FIGS. 3 and 4, the description will be made as to the situation in which the developer container 4 is mounted to or demounted from the rotary type developing device 27. First, the description will made as to the mounting of the developer container 4. The operator grips the tag portion 5*b* of the knob 5 of the developer container 4 and inserts the developer container 4 into the rotary type developing device 27 with the knob 5 at the front side.

At this time, the container may be exchanged at any position of the rotary type developing device 27. In the example shown in FIG. 2 of this embodiment, the container is exchanged when the cyan developing device 27C is at the position indicated. Therefore, in FIGS. 3 and 4, the developer container 4 takes a low opposition, and the developing device 22 takes an upper position.

If the container is exchanged at the position of the cyan developing device 27C in FIG. 2, the exchange operation can be carried out with the discharge opening 4*b* of the developer container 4 facing up, and therefore, there is leased liability of scattering the developer through the discharge opening 4*b*, and for this reason, the position is preferable.

As shown in FIG. 3, when the developer container 4 is being inserted, the container shutter 6 of the disengagement image material container 4 is first brought into engagement with the developing device side shutter 11 provided in the developing device 22 side. Subsequently, the segment gear 6*a* of the container shutter 6 of the developer container 4 is brought into engagement with the developing device side gear 10 which is a rotating force transmission member provided in the developing device 22 side. Finally, the segment gear 5*c* of the knob 5 is brought into engagement with the developing device side gear 10.

The developing device side gear 10, as shown in FIGS. 3 and 4, is a two-stage gear wherein the diameter of the dedendum circle is larger at the downstream stage with respect to the inserting direction. And, the segment gear 6*a* provided on the container shutter 6 is engaged with a large dedendum-circle-diameter portion of the gear 10 of the developing device, and the segment gear 5*c* provided on the knob 5 is engaged with the small dedendum-circle-diameter of the developing device gear 10.

Then, the operator rotates the tag portion 5*b* of the knob 5 in the clockwise direction in FIG. 4, by 60°, by which the driving force provided by the rotation is transmitted to the segment gear 6*a* of the container shutter 6 through the developing device side gear 10 from the segment gear 5*c* of the knob 5. By the thus transmitted driving force, the container shutter 6 slides in the circumferential direction of the developer container 4 while being in engagement with the rib 4*c*.

At this time, the developing device side shutter 11 moves in interrelation with the sliding movement of the container shutter 6 of the developer container 4, so that discharge opening 4*b* of the developer container 4, the opening 11*a* of the developing device side shutter 11 and the opening 14*a* of the developer receiving portion 14, are simultaneously opened.

The description will be made as to the removal of the developer container 4. The operator first grips the tag portion 5*b* of the knob 5, and rotates it in the counterclockwise direction in FIG. 4 by 60°. By this, a driving force in the opposite direction is transmitted, so that container shutter 6 slides in the opposite direction, by which the discharge opening 4*b* of the developer container 4, the opening na of the developing device side shutter 11 and the opening 14*a* of the developer receiving portion 14 are simultaneously closed. The operator grips the tag portion 5*b* of the knob 5 and takes the developer container 4 out of the rotary type developing device 27.

The developing device side shutter 11 functions to prevent the developer from leaking out of the developer receiving portion 14 even when the developer container 4 is disengaged, and therefore, the necessary thereof is high in the developing device 27.

(Locking Means)

The knob 5 has the segment gear 5*c* only a part of the outer periphery, and therefore, the angular position (phase) of the knob 5 has to be a predetermined position at the time when the segment gear 5*c* of the knob 5 is brought into engagement with the developing device side gear 10. In order to assure this, some locking means is desirably provided to make it sure that knob 5 is locked against rotation before the mounting of the developer container 4, and after the mounting, the it is released to permit rotation of the knob 5.

The description will be made as to the locking means. As shown in FIG. 6, the arm portion 5*d* of the knob 5 is arcuate and extends from a connecting portion relative to the flange portion 5*a* toward downstream with respect to a rotational direction for opening the container shutter 6.

Adjacent a free end of the arm portion 5*d* integral with the knob 5 (ejection-molded resin material) (rotatable member), there is provided a release portion 5*e* which is in the form of a projection projected from a portion extended outward in a radial direction form a circumferential surface of the knob 5 (rotatable member) from the outer surface of the arm portion 5*d*. Adjacent the free end of the plate-like arm portion 5*d*, there is provided a locking engaging portion 5*f* which is in the form of a projection projected toward the developer accommodating portion 4*a* which is the main body of the developer container 4, the locking engaging portion 5*f* being integral with the knob 5 (rotatable member).

If an attempt is made to rotate the knob before setting it in the main assembly of the image forming apparatus, the locking engaging portion 5*f* is abutted to a portion to be locked 4*d* which has a function of a stopper, so that rotation of the knob is stopped.

Together with the mounting operation of the developer container 4 into the main assembly of the image forming apparatus, the release portion 5*e* is abutted to the abutting portion 100 provided at the developing device 22 side, by which and is urged in a direction indicated by arrow C. This makes the locking engaging portion 5*f* to displace in the direction opposite the mounting direction to a position where it is unable to abut the portion to be locked 4*d* provision at the developing device side. In addition, the arm portion 5*d* extends toward downstream with respect to the direction of rotation of the knob 5 (rotatable member) after release of the locking engaging portion 5*f* (locking portion).

The knob 5 has a cylindrical guide portion 5*g* and a claw portion 5*h*. By the claw portion 5*h*, the knob 5 is unified with the developer accommodating portion 4*a*, but is rotatable along the cylindrical guide portion 5*g*. The developer accommodating portion 4*a* which is the main body of the developer container 4 is provided with an integral portion to be locked 4*d* (portion to be locked) in the form of a projection projected toward the knob 5 (rotatable member) from the developer accommodating portion 4*a*, by the engagement between the portion to be locked 4*d* and the rotatable member (locking portion), the rotation of the knob 5 is limited.

It is desirable that knob 5 is limited relative to the developer accommodating portion 4*a* such that it is capable of rotate only through an angle corresponding to the segment gear 5*c* even after it is released. This can be accomplished by providing some engaging portion provided on the cylindrical guide portion 5*g* or on the claw portion 5*h* and engaging it with the developer accommodating portion 4*a*.

When the developer container 4 is inserted into the developing device 27, the release portion 5*e* is brought to abutment to the abutting portion 100 provided in the developing device 22, by which it receives a force in the direction indicated by an arrow C in FIG. 6 resulting in that arm portion 5*d* elastically deforms, and the engagement between the locking engaging portion 5*f* and the portion to be locked 4*d* is released. On the contrary, upon disengagement, the developer container 4 is drawn out, the arm portion 5*d* returns to the original position by the restoring force of the arm portion 5*d*, so that locking engaging portion 5*f* and the portion to be locked 4*d* are re-engaged and re-locked with each other.

In this manner, according to this embodiment, despite the fact that release portion 5*e* is provided at only one position, a smooth and assured release is possible. This is because, the releasing is effected by a displacement of an arm portion 5*d* in the form of a cantilever, and the displacement is a circle motion about a base portion of the arm portion 5*d*, and therefore, there is no liability of clogging during the displacement.

The arm portion 5*d* having the integral locking engaging portion 5*f* (locking portion) is displaceable in the mounting direction of the developer container 4 and is urged by its own elastic force (restoring force) in the direction of regulating the rotation of the knob 5 (rotatable member). The locking engaging portion 5*f* (locking portion), in the free state (not receiving the force) is engaged with the portion to be locked 4*d* provided in the developer container 4 and is placed at a position of limiting the rotation of the knob 5 (rotatable member).

As described in the foregoing, the arm portion 5*d* is in the form of a flat plate extending in the rotational direction of the knob 5 (rotatable member) (the rotational direction for opening the container shutter, namely, the direction in which the rotation of the rotatable member is limited), so that deformation of the arm portion 5*d* is easy in the mounting direction of the developer container 4, namely, the direction of the rotational axis, whereas the deformation is not easy in the radial direction of the knob 5 (rotatable member). Therefore, the arm portion 5*d* is preferable. However, the present invention is not limited to this structure.

The arm portion 5*d* of this embodiment is arcuate, but the present invention is not limited to this, and it may be linear. The arcuate shape is preferable since the space can be effectively used, and since it is tough against an external force.

The length of the arcuate arm portion 5*d* may be any, but it is preferable that it extends over 20°–180°, further preferably 30–120°, even further preferably 40–100°.

If the length of the arm portion 5*d* is too large, the rigidity of the arm portion 5*d* lowers with the result of lower locking strength and the high liability of damage by an external force such as falling impact or the like. If the length of the arm portion 5*d* is too short, the rigidity is too high with the result of necessity of large force to release the locking.

Figure 7:
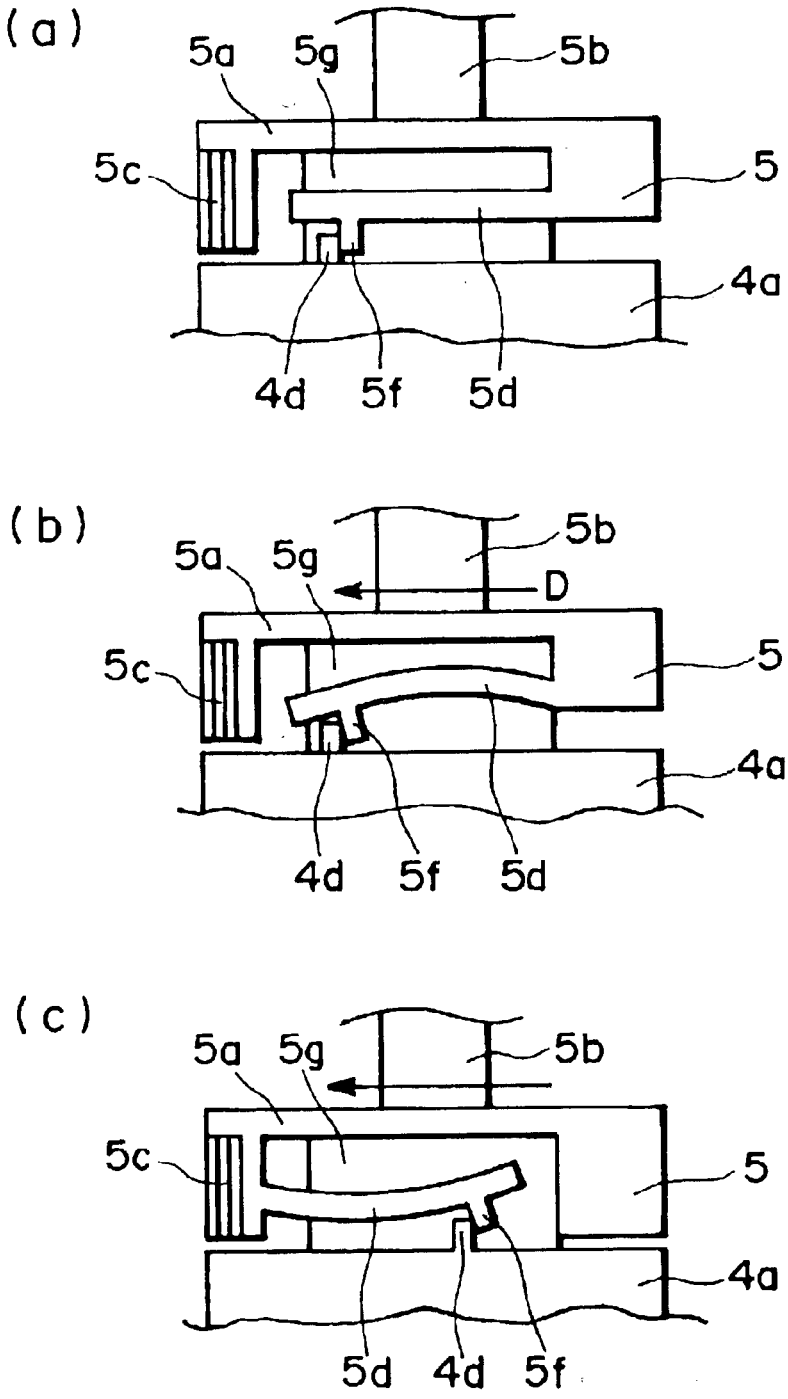
FIGS. 7(*a*) through 7(*c*) are side views illustrating engagement between a locking portion of a rotatable member and a portion to be locked of a main body of a developer container.

Referring to FIGS. 7(*a*) through 7(*c*), a description will be made as to the situation in which an attempt is made to rotate the knob 5 in a locked state (before the developer container 4 is mounted to the main assembly of the image forming apparatus). FIG. 7, (*a*) shows a state in which the locking engaging portion 5*f* and the portion to be locked 4*d* are engagement with each other (locked state), and no rotating force is imparted to the knob 5.

FIG. 7, (*b*) shows a state in which a rotating force is imparted to the knob 5 in the clockwise direction as seen from a front side of the apparatus (the direction indicated by arrow D in FIG. 7, (*b*)). In FIG. 7, (*b*), the force is imparted in the direction indicated by arrow D, but the arm portion 5*d* is prevented from moving by the abutment between the locking engaging portion 5*f* and the portion to be locked 4*d* adjacent the free end, and therefore, the arm portion 5*d* receives a compression force with the result of deformation indicated in FIG. 7, (*b*) (in FIG. 7, (*b*), the deformation is exaggerated).

This is because the locking engaging portion 5*f* and the portion to be locked 4*d* are engaged with each other. The arm portion 5*d* deforms such that bottom side becomes concave. This deformation tends to enhance the engagement of the locking engaging portion 5*f* with the portion to be locked 4*d*, thus accomplishing the effective locking. This is because the arm portion 5*d* extends toward downstream with respect to the direction of rotation of the knob 5. In addition, this is because there is no tapered portion at each of the surfaces of the projection 5*f* and the projection 4*d* which are abutted to each other and because they are projected substantially perpendicularly from the main body of the container. The projection 5*f* and the projection 4*d* projected substantially perpendicularly from the main body of the container and the arm portion can be manufactured by integral ejection molding with the knob and the main body of the container.

On the other hand, FIG. 7, (*c*) shows a case in which the arm portion 5*d* is extended toward the upstream with respect to the rotational direction of the knob 5 (that is, the direction opposite the direction for opening the container shutter, namely, the direction opposite the arm portion 5*d* knob 5 limiting direction). In this case, the arm portion 5*d* is limited against the movement by the engagement between the locking engaging portion 5*f* at the free end and the portion to be locked 4*d*, so that stretching force is imparted to the arm portion 5*d*. Since the locking engaging portion 5*f* is limited by the portion to be locked 4*d* at the bottom side of the arm portion 5*d* as shown in FIG. 7, (*c*), so that arm portion 5*d* is deformed concave-up as contrasted to FIG. 7, (*b*). In this FIG. 7, (C), the deformation is again exaggerated). This results in more shallow engagement between the locking engaging portion 5*f* and the portion to be locked 4*d* so that locking tends to be released. In a worst case, the locking is unintentionally released.

The locking strength was measured by forcedly releasing the locking by rotating the knob 5. With the configuration of FIG. 7, (*b*), the locking is kept even under the force of 100 N. But, with the configuration of FIG. 7, (*c*) which is different only in the direction of extension of the arm, the locking is released by a force of approx. 20 N.

Figure 8:
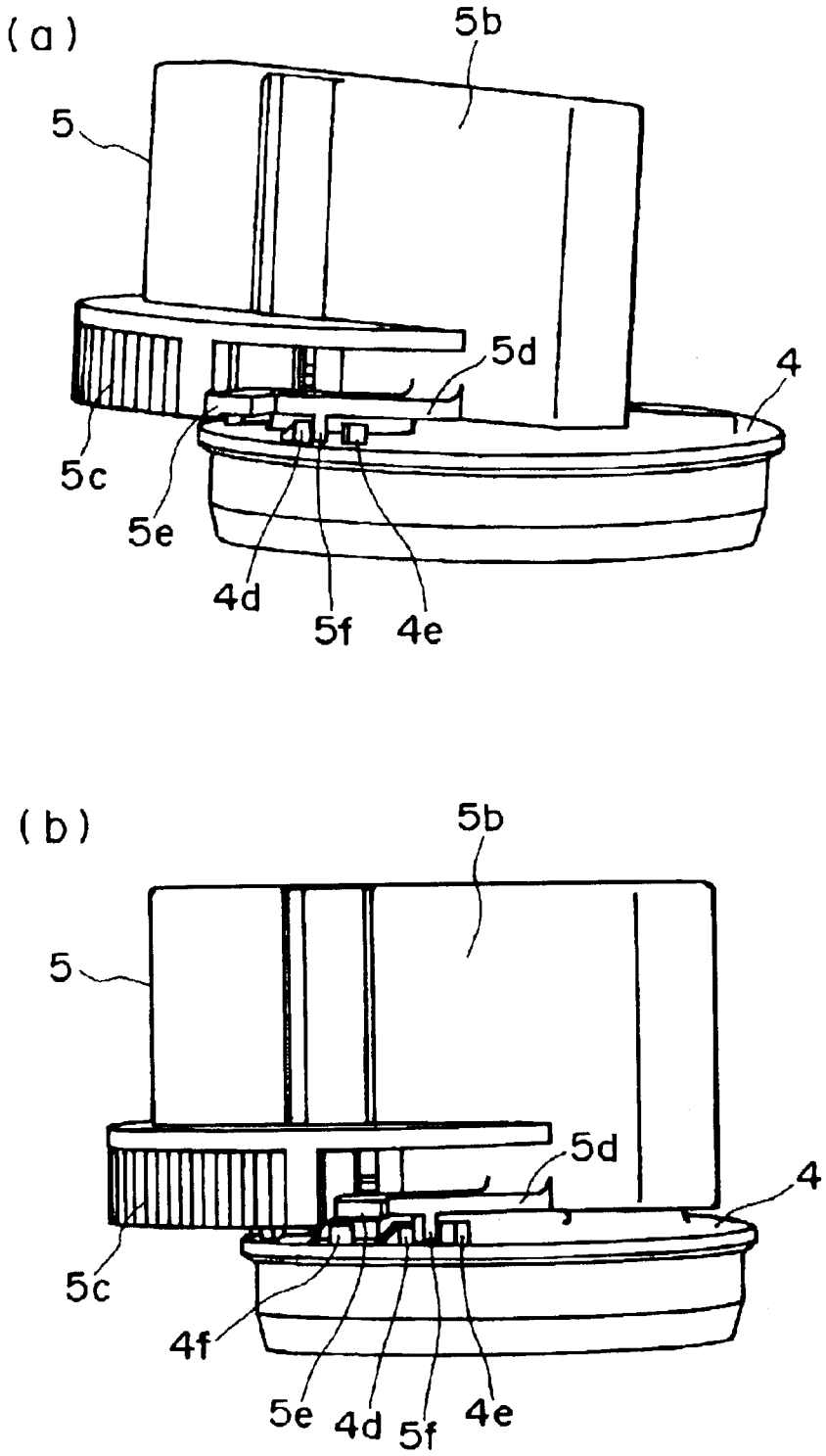
FIGS. 8(*a*) and 8(*b*) are partial side views of a developer container according to a second embodiment of the present invention.

Referring to FIGS. 8(*a*) and 8(*b*), a description will be made as to a second embodiment of the developer container according to the present invention. FIGS. 8, (*a*) and (*b*) are side views of the developer container according to a second embodiment of the present invention. The same reference numerals as in the first embodiment are assigned to the elements having the corresponding functions, and the detailed description thereof are omitted for simplicity.

In this embodiment, as shown in FIG. 8, (*a*), a projection 4*e* (second portion to be locked) is provided at a position upstream of the portion to be locked 4*d* (portion to be locked) of the main body of the developer container 4 with respect to the rotational direction of the knob 5 (rotatable member), and the projection 4*e* is also engaged with the locking engaging portion 5*f*. By this, the rotation of the knob 5 in the opposite direction (the closing direction of the container shutter 6) is limited.

As shown in FIG. 8, (*b*), a third portion to be locked in the form of a projection 4*f* downstream of the portion to be locked 4*d* (portion to be locked) of the main body of the developer container 4 with respect to the rotational direction of the knob 5 (rotatable member), the projection 4*f* is engageable with the locking engaging portion 5*f*. By this, the knob 5 is prohibited from rotating too much in the opening direction of the container shutter 6 after the release.

In the embodiment shown in FIGS. 8(*a*) and 8(*b*), the rotatable range of the knob 5 is limited using the locking engaging portion 5*f* provided adjacent a free end of the arm portion 5*d*. With this structure, there is no need of the provision of an additional engageable portions to limit the rotatable range of the knob 5. Since the locking engaging portion 5*f* and the projections 4*e*, 4*f* are disposed adjacent the outer periphery of the flange portion 5*a* of the knob 5, the operator can clearly feel the rotatable range of the knob 5.

Figure 11:
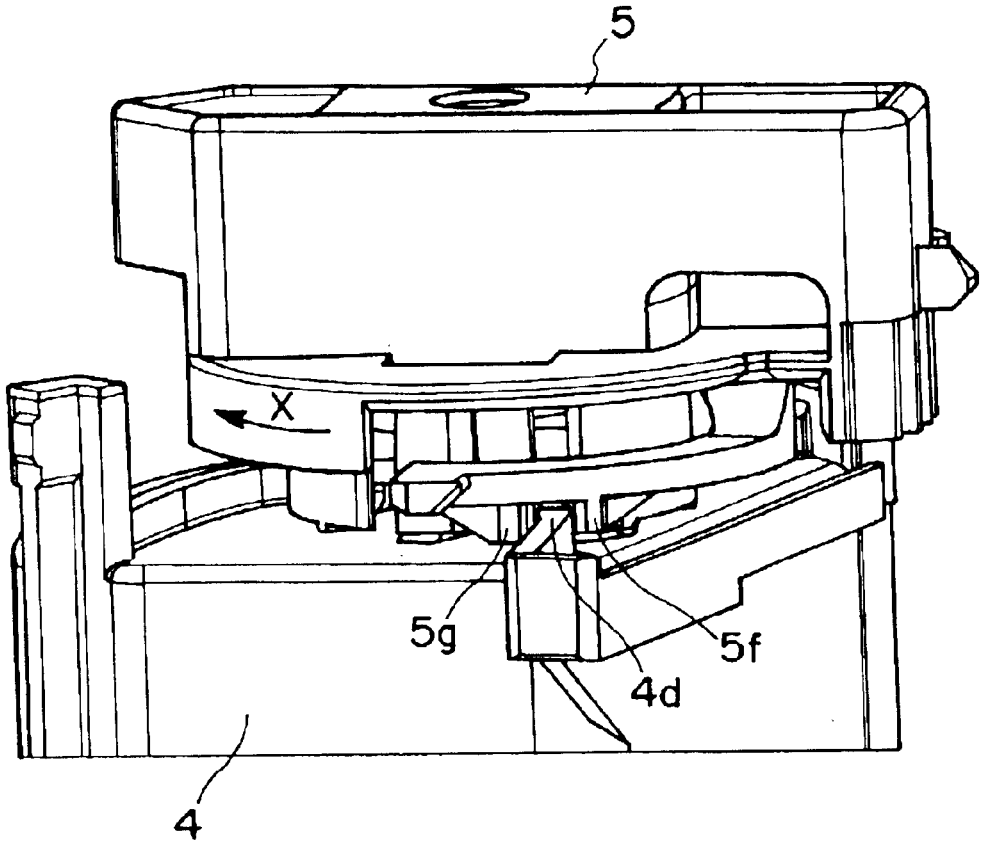
FIG. 11 is a top plan view and a perspective view showing a modified example of a rotatable member of a developer container according to an embodiment of the present invention.

The structure of the knob shown in FIGS. 8(*a*) and 8(*b*) may be as shown in FIG. 11. More perpetually, a projection 5*f* for limiting the rotational direction of the knob for opening the container shutter is provided in the similarly to the embodiment, and a projection 5g for limiting the rotational direction of the knob for closing the container shutter is provided on the knob. With this structure, the same advantageous effects as with the foregoing embodiments are provided.

Figure 9:
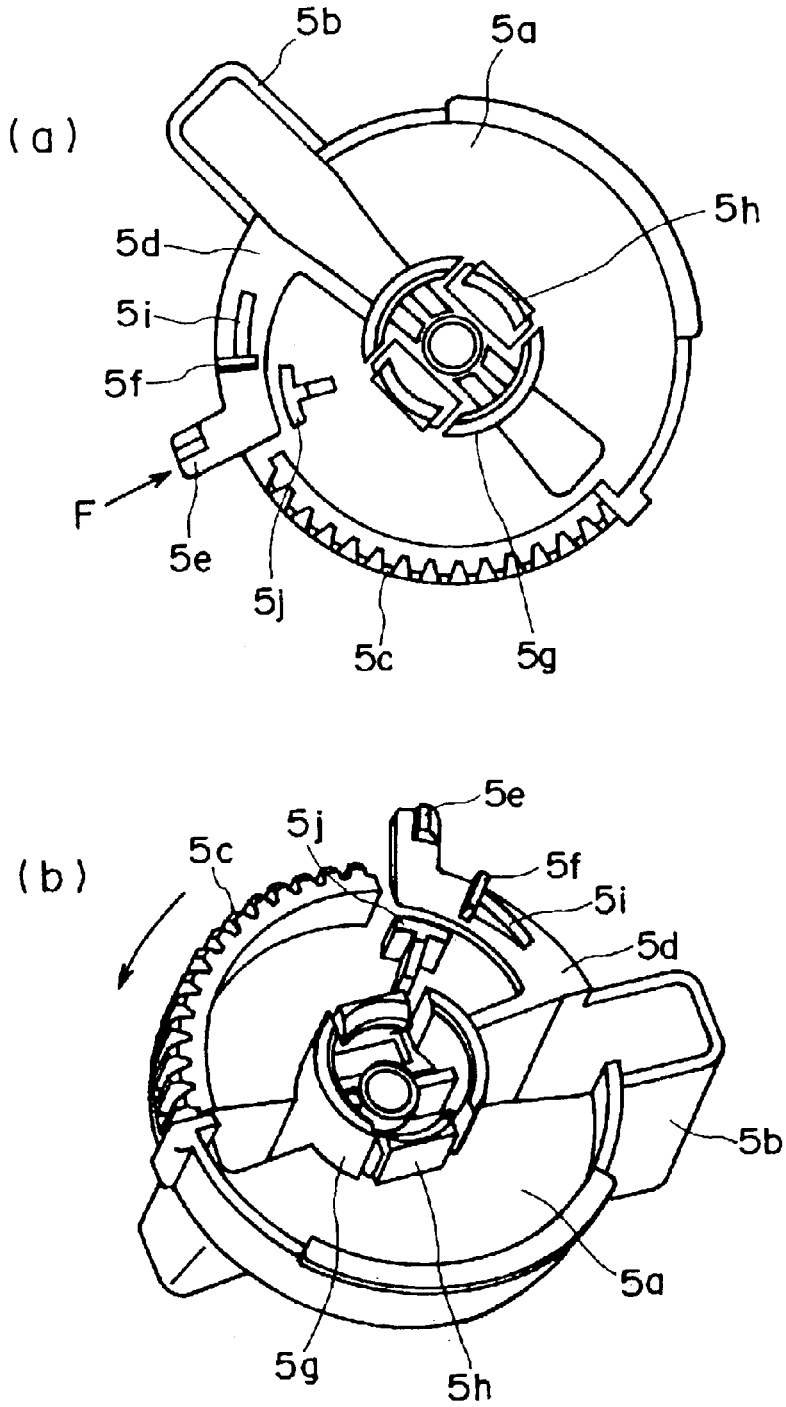
FIGS. 9(*a*) and 9(*b*) are a top plan view and a perspective view of a rotatable member of a developer container according to a third embodiment of the present invention.

Referring to FIGS. 9(*a*) and 9(*b*), a description will be made as to a third embodiment of the developer container according to the present invention. FIGS. 9, (*a*) and (*b*) are a top plan view and a perspective view illustrating a structure of a rotatable member of the developer container according to a third embodiment of the present invention. The same reference numerals as in the foregoing embodiments are assigned to the elements having the corresponding functions, and the detailed descriptions of such elements are omitted for simplicity.

In this embodiment, as shown in FIGS. 9, (*a*) and (*b*), there is provided a tapered portion 5*i* on the surface of the arm portion 5*d* which is opposed to the main assembly side of the developer container 4. The tapered portion 51 functions a guiding portion for guiding from the non-locking position to the locking position of the knob 5.

The tapered portion 5*i* extends from the locking engaging portion 5*f* (projection) and has a decreasing height toward the upstream with respect to the rotational direction of the knob 5. Because of the provision of the tapered portion 5*i*, when the knob 5 is rotated in the opposite direction (the direction for closing the container shutter 6), the locking engaging portion 5*f* smoothly rides over the portion to be locked 4*d* until it is locked again.

It functions when the knob 5 is rotated in the counter-clockwise direction as seen from the front side of the apparatus in an attempt to remove the developer container 4, but it also functions when the locking is disengage for one reason or another prior to mounting of the developer container 4. That is, in that case, the re-locking is established simply by rotating the knob 5.

As an alternative structure of the guiding portion for guiding the knob 5 from the release position to the locking position, a tapered projection may be provided on such a side of the developer accommodating portion 4*a* as is opposed to the knob 5.

As shown in FIGS. 9, (*a*) and (*b*), in this embodiment, there is provided, on an inside of the arcuate arm portion 5*d*, a regulating portion, interval with the knob 5, for limiting deformation of the arm portion 5*d* at the time when the arm portion 5*d* receives an external force F in the radial direction of the knob 5, and a projection 5*j* is provided projected from the flange portion 5*a* toward the main body of the developer container 4.

The projection 5*j* is abutted to the arm portion 5*d* when the release portion 5*e* receives an external force due to falling on the container during transportation to limit the deformation of the arm portion 5*d*. The arm portion 5*d* is in the form of a cantilever and is flexible, and therefore, it may be deformed, broken or blanched at the base portion, but the liability can the avoided by the provision of the projection 5*j*.

The projection 5*j* is preferably disposed very close to the arm portion 5*d* adjacent the free end of the arm portion 5*d*. The configuration of the projection 5*j* may be any, but as shown in FIGS. 9, (*a*) and (*b*), it is preferably T-shaped comprising a side for abutment to the arm portion 5*d* and a back side for back up the abutment side.

Figure 10:
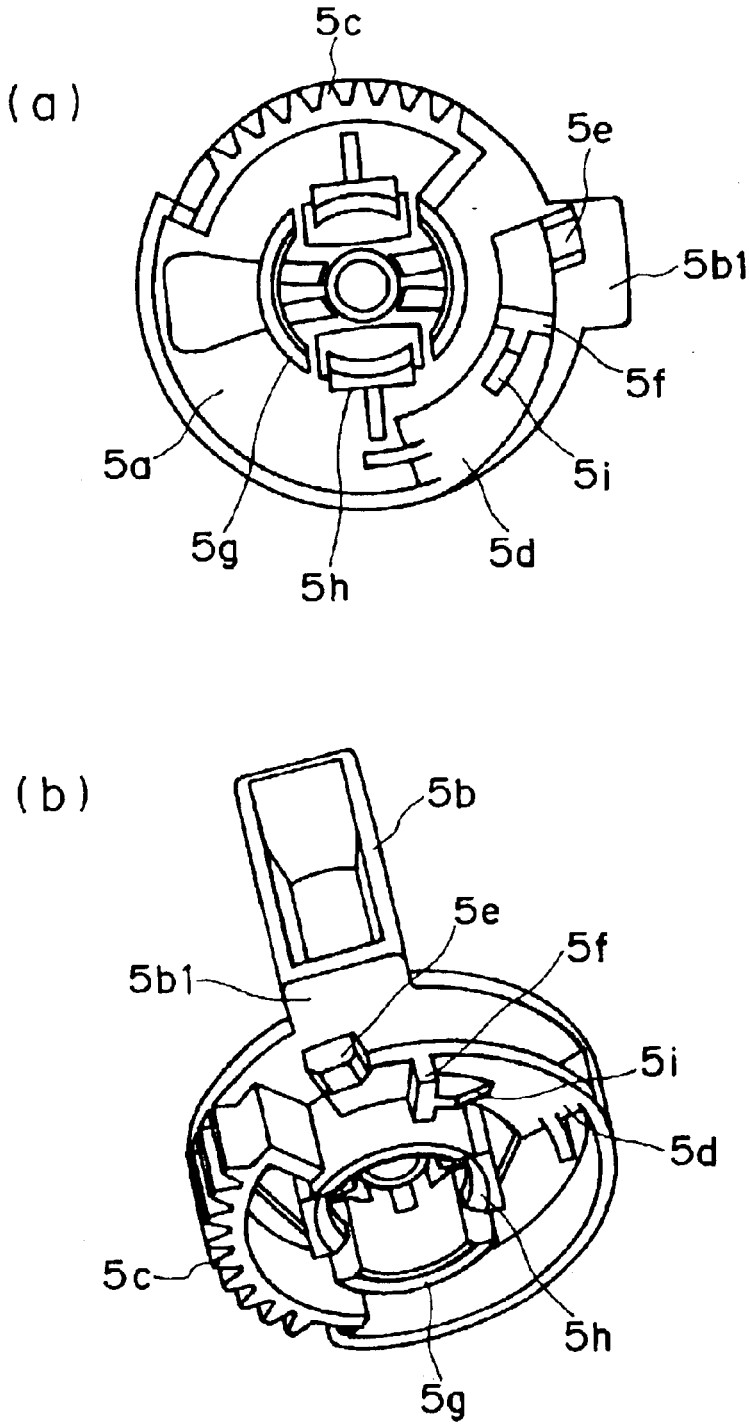
FIGS. 10(*a*) and 10(*b*) are a top plan view and a perspective view of a rotatable member of a developer container according to a fourth embodiment of the present invention.

Referring to FIGS. 10(*a*) and 10(*b*), a description will be made as to a fourth embodiment of the developer container according to the present invention. FIGS. 10, (*a*) and (*b*) are a top plan view and a perspective view illustrating a structure of a rotatable member of the developer container according to a third embodiment of the present invention. The same reference numerals as in the foregoing embodiments are assigned to the elements having the corresponding functions, and the detailed descriptions of such elements are omitted for simplicity.

This embodiment includes a feature in the configuration of the tag portion 5*b*. The tag portion 5*b*, similarly to the foregoing embodiments, straight projection, but it is a projected portion 5*b*1 extended radially outwardly of the rotation of the knob 5 (rotatable member) and the angular position (phase) thereof is substantially aligned with the release portion 5*e*.

The projected portion 5*b*1 of the tag portion 5*b* is disposed upstream of the release portion 5*e* with respect to the mounting direction of the developer container 4, and the diameter of the outermost portion of the tag portion 5*b* is not less than the diameter of the outermost portion of the release portion 5*e*.

With such a structure, an impact force upon falling during transportation, for example, is received by the projected portion 5*b*1, so that release portion 5*e* does not receive a force, and therefore, the deformation, damage or blanching of the arm portion 5*d* can be prevented.

When the operator handles the container, the release portion 5*e* in the form of the projection is disposed at the back side of the projected portion 5*b*1 of the knob 5, the erroneous operation (the release portion 5*e* is unintentionally touched to release the locking) can be made relatively seldom.

In this embodiment, the configuration of the arm portion 5*d* is characterized. The arm portion 5*d*, as shown in FIG. 10(*a*), has a cross-sectional area which decreases from the base portion toward the free end. Because of the structure, the stress concentration at the base portion of the arm portion 5*d* during the operation of the arm portion 5*d* can be avoided, so that substantially the entirety of the arm portion 5*d* deforms, and therefore, the blanching or the possible cracking of the base portion can be avoided.

(Other Embodiments)

The present invention is not limited to the foregoing Embodiments, but can be modified within the concept of the present invention. For example, in the foregoing embodiments, the locking engaging portion 5*f* (locking portion) and the portion to be locked 4*d* (portion to be locked) are both projections, but either one of them may be a recessed portion. In such a case, a compact design is accomplished.

However, if the main body side of the developer container 4 is constituted by a recess, the following is to be taken into consideration. That is, when the developer accommodating portion 4*a* is constituted by two parts (upper portion material 4*a*1 and lower portion material 4*a*2) as in Embodiment 1, a metal mold structure for the member having the recess may be complicated because the necessity may arise for a so-called inner slide.

In the foregoing embodiments, the arm portion 5*d* which displaces between the looking position and the releasing position is provided on the arm portion 5*d,* but it is a possible alternative that arm portion or another displaceable member may be provided on the developer container 4 side.

More particularly, in the foregoing embodiments, the locking engaging portion 5*f* (locking portion) is provided on the knob 5 side, and the portion to be locked 4*d* (portion to be locked) is provided on the main body side of the developer container 4. However, the locking portion may be provided on the knob 5 (rotatable member) side, and the portion to be locked may be provided on the main body side (developer container 4).

In the foregoing embodiments, the arm portion 5*d* and the knob 5 are injection-molded, and the arm portion 5*d* restores to the locking portion by the elasticity of the material per se. But, it is possible to use a leaf spring, coil spring or the like to strongly urge toward the locking position.

As described in the foregoing, the present invention provides a developer container having a compact locking means. This is particularly advantageous when the developer container is used with a rotary type developing device 27 with which the space is limited. In the foregoing embodiments, therefore, the description has been made with respect to the case in which the developer container is mounted to a rotary type developing device 27, however, the present invention is applicable to a stationary type developing device or a developing device having single developing means.

In the foregoing description, the developer may be a one component developer which comprises toner only, and to a two component developer comprising nonmagnetic toner particles and magnetic carrier particles. Correspondingly, the developer contained in the toner supply container is the toner in the former case and a mixture of the toner and the carrier in the latter case.

According to the above-described embodiments, there is provided a developer container of a type in which a rotational driving force of the rotatable member is transmitted to the container shutter through drive transmitting means of the main assembly of the apparatus to open and close the container shutter, and an image forming apparatus, wherein there is provided compact rotatable member locking means which comprises a small number of parts and which is not easily broken during transportation.

Thus, the rotatable member can be locked at low cost with simple structure which requires small space.

In addition, even if it is left for a long term with the locked state, creep deformation of the locking portion does not occur, therefore, the locking function is maintained for the long term.

Furthermore, the locking portion is integral with the rotatable member, and is provided with a release portion for receiving a force displacing the locking portion in the releasing direction, and at least a portion thereof is protruded in the radial direction of the rotatable member beyond the main body of the developer container. If the release portion is provided on the protruded portion, the locking member is released simply by mounting the developer container into the image forming apparatus since the release portion is protruded.

The locking portion is an arm portion formed integrally with the rotatable member. When it extends toward downstream with respect to the rotational direction of the rotatable member after the release, an application of a force to rotate the rotatable member in the unlocking direction, the arm portion tends to be compressed, so that unlocking is resisted. Therefore, the locking is not unintentionally released.

Th arm portion is preferably arcuate extending along the rotation of the rotatable member, and adjacent the free end of the arm portion, there is provided an engaging portion for engagement with the portion to be locked provided in the main body of the developer container.

In a preferable arrangement, the mounting direction of the developer container into the image forming apparatus is along the rotational axis direction of the rotatable member, and the arm portion is in the form of a plate extending in the rotational direction of the rotatable member, so that it displaces easy in the mounting direction, and is not easily displaces in the radial direction of the rotatable member.

In a further preferable arrangement, the engaging portion which is provided in the neighborhood of the free end of the arm portion, is in the form of a projection projected toward the main body of the developer container from the arm portion.

With such structures, even upon application of the rotational force to the rotatable member in the unlocking direction, results in the force applied to the arm portion in the compressing direction, so that arm portion deforms. However, the deformation is such that engagement between the compression and the portion to be locked is firmer, and therefore, the unlocking does not easily occur. So, inadvertent unlocking can be effectively avoided.

In addition, when the release portion is disposed adjacent to the free end of the arm portion and is a projection projected outwardly in the radial direction of the rotatable member, the release portion is integral with the arm portion, and is disposed and the free end, so that arm portion is assuredly deformed for unlocking.

When the portion to be locked is in the form of a projection projected toward the rotatable member from the main body of the developer container, the portion to be locked can be formed using a simple metal mold without reducing the inside volume of the developer container.

In the case that rotatable member includes a tag portion for rotation by an operators hand; the tag portion is disposed upstream of the release portion with respect to the mounting direction of the developer container; at least a part thereof is projected from the rotatable member in the radial direction; the projected portion is substantially aligned with the release portion in phase; the diameter of the outermost portion of the tag portion is not less than a diameter of the outermost portion of the release portion, then the tag portion is protruded beyond the release portion, therefore, the release portion is not easily touched by the operators hand, so that liability of unlocking before the mounting can be avoided. In addition, when the container receives impact due to falling or the like, the impact can be received by the tag portion, so that release portion is prevented from being impacted, and therefore, the arm portion is not broken.

When the guiding portion for guiding from the releasing position to the locking position, even if the container is unlocked before it is mounted in the apparatus, the locking position can be easily restores simply by rotating the tag portion. Also, when the rotatable member is rotated in the shutter closing direction after the container is mounted to the apparatus, it is easily re-locked. Therefore, the developer container can be kept locked even if it is once mounted into the apparatus and then is taken out of apparatus.

When the guiding portion includes a tapered projection from the arm portion faced to the main body of the developer container, the smooth re-locking is possible with a simple structure.

When the guiding portion includes a tapered projection formed on the side face to the rotatable member, the smooth re-locking is possible with a simple structure.

When a second rotation is disposed upstream or downstream of the portion to be locked with respect to the rotational direction of the rotatable member for closing the container shutter in order to limit the rotation in the direction closing the container shutter of the rotatable member, the rotation of the rotatable member in the wrong direction can be assuredly prevented. In addition, the operator can easily feel the complete closure of the container shutter by the completion of the rotation of the rotatable member.

When a third portion to be locked is provided downstream of the portion to be locked with respect to the rotational direction of the rotatable member for opening the container shutter in order to limit the rotation of the rotatable member in the direction of opening the container shutter, a further rotation of the rotatable member in the container shutter opening direction after the container shutter is completely open, can be assuredly prevented. In addition, the operator can easily feel the complete opening of the container shutter by the completion of the rotation of the rotatable member.

When there is provided inside the arm portion a limiting portion for limiting deformation of the arm portion when the arm portion receives an external force in the radial direction of the rotatable member, the deformation of the arm portion is limited so that blanching or damage of the arm portion can be effectively prevented.

When the regulating portion is provided integral with the rotatable member and is in the form of a projection projected toward the main body of the developer container, the deformation of the arm portion can be limited irrespective of the rotational position of the rotatable member, so that arm portion can be effectively protected.

Therefore, the rotatable member can be locked with a simple structure without the necessity of provision of a separate locking member.

In addition, a compact locking means for the rotatable member can be provided which can be placed in a small space as with the case of a rotary type developing device.

Moreover, even if only one release portion is provided, the release operation is stabilized.

Furthermore, the locking means is not easily disengaged even upon impact applied thereto when the container is let fall.

While the invention has been described with reference to the structures disclosed herein, it is not confined to the details set forth and this application is intended to cover such modifications or changes as may come within the purpose of the improvements or the scope of the following claims.

What is claimed is:

1. A developer supply container detachably mountable to an image forming apparatus, said developer supply container comprising:

a main body for accommodating a developer;

a discharge opening, provided in the main body, for permitting discharge of the developer;

a shutter member for opening and closing said discharge opening;

a rotatable member which is rotatable relative to the main body to effect opening and closing movement of said shutter member;

a regulating member for limiting a rotation of said rotatable member in a direction of opening said shutter member, wherein said regulating member includes an extended portion integral with said rotatable member and extended substantially along the opening rotational direction of said rotatable member and a limiting projection, projected from said extended portion toward said main assembly, for abutment to a stopper projection of the main body, wherein said regulating member has an abutting portion for abutment to an image forming apparatus in a mounting operation of said developer supply container, and said limiting projection displaces to a position where it is incapable of abutting said stopper projection.

2. A container according to claim 1, wherein before said developer supply container is set in said image forming apparatus, said regulating member limits rotation of said rotatable member without said extended portion receiving a force in the mounting direction.

3. A container according to claim 1, wherein said abutting portion is disposed adjacent a free end portion with respect to a direction of extension of said extended portion.

4. A container according to claim 1, wherein said extended portion includes a displacement prevention portion for preventing radially inward displacement of said rotatable member.

5. A container according to claim 1, wherein said regulating member is integrally molded from a resin material together with said rotatable member.

6. A container according to claim 1, further comprising a limiting projection, projected from said extended portion toward the main body, for abutment to a stopper projection to limit a rotation of rotatable member in the direction of closing said shutter member.

7. A container according to claim 1, wherein said rotatable member includes a first gear portion for meshing engagement with a first gear member provided in said image forming apparatus, and a second gear portion for meshing engagement with a second gear member which is provided in said image forming apparatus and which is rotatable with said first gear member, wherein by mounting said developer supply container to said image forming apparatus, a driving connection is established between said first gear portion and said second gear portion through said first gear member and said second gear member.

8. A container according to claim 7, wherein a drive transmission path between said first gear portion and said second gear portion is disconnected before said developer supply container is mounted to said image forming apparatus.

9. A developer supply container removably settable in an image forming apparatus, said developer supply container comprising:

a main body for accommodating a developer;

a discharge opening, provided in the main body, for permitting discharge of the developer;

a shutter member for opening and closing said discharge opening;

a rotatable grip member which is rotatable relative to the main body to open and close said shutter member;

a regulating member for regulating a rotation of said grip member before said developer supply container is set in said image forming apparatus;

wherein said regulating member is integrally molded from a resin material together with said grip member.

10. A container according to claim 9, wherein said rotatable member includes a first gear portion for meshing engagement with a first gear member provided in said image forming apparatus, and a second gear portion for meshing engagement with a second gear member which is provided in said image forming apparatus and which is rotatable with said first gear member, wherein by mounting said developer supply container to said image forming apparatus, a driving connection is established between said first gear portion and said second gear portion through said first gear member and said second gear member.

11. A container according to claim 10, wherein a drive transmission path between said first gear portion and said second gear portion is disconnected before said developer supply container is set in said image forming apparatus.

* * * * *

UNITED STATES PATENT AND TRADEMARK OFFICE

CERTIFICATE OF CORRECTION

PATENT NO. : 6,839,533 B2
DATED : January 4, 2005
INVENTOR(S) : Yutaka Ban et al.

It is certified that error appears in the above-identified patent and that said Letters Patent is hereby corrected as shown below:

Column 2,
Line 30, "portion" should read -- portions --.

Column 3,
Line 4, "to" should read -- being fitted to --; and
Line 51, "and" should read -- a --.

Column 4,
Line 11, "functions" should read -- function --;
Line 22, "is" should read -- it is --;
Line 25, "have" should read -- has --; and
Line 51, "device" should read -- devices --.

Column 5,
Line 6, "contains" should read -- which contains --;
Line 14, "Decimated by" should read -- Designated by reference numeral --;
Line 21, "formal" should read -- form of --; and
Line 54, "the" should read -- to the --.

Column 7,
Line 4, "low opposition" should read -- lower position --;
Line 9, "leased" should read -- least --;
Line 54, "na" should be deleted; and
Line 66, "only" should read -- at only --.

Column 8,
Line 1, "a" should read -- at a --;
Line 7, "the it" should read -- that it --;
Line 18, "form" should read -- from --;
Line 35, "and" should read -- it --;
Line 39, "provision" should read -- provided --;
Line 57, "rotate" should read -- rotating --; and
Line 66, "resulting in that" should read -- with the result that --.

UNITED STATES PATENT AND TRADEMARK OFFICE

CERTIFICATE OF CORRECTION

PATENT NO. : 6,839,533 B2
DATED : January 4, 2005
INVENTOR(S) : Yutaka Ban et al.

It is certified that error appears in the above-identified patent and that said Letters Patent is hereby corrected as shown below:

Column 9,
Line 55, "engagement" should read -- engaged --.

Column 10,
Line 30, "In this" should read -- In --; and
Line 48, "are" should read -- is --.

Column 11,
Line 3, "portions" should read -- portion --;
Line 8, "perpetually," should read -- preferably, --;
Line 10, "in the" should be deleted;
Line 29, "51" should read -- 5i --;
Line 43, "disengage" should read -- disengaged --; and
Line 54, "interval" should read -- integral --.

Column 12,
Line 32, "blanching" should read -- branching --; and
Line 67, "looking" should read -- locking --.

Column 13,
Line 63, "Th" should read -- The --.

Column 14,
Line 5, "displaces easy" should read -- is easily displaced --;
Line 6, "displaces" should read -- displaced --;
Line 12, "even upon" should be deleted;
Line 30, "operators hand;" should read -- operator's hand, --;
Line 38, "operators" should read -- operator's --; and
Line 47, "restores" should read -- restored --.

UNITED STATES PATENT AND TRADEMARK OFFICE

CERTIFICATE OF CORRECTION

PATENT NO. : 6,839,533 B2
DATED : January 4, 2005
INVENTOR(S) : Yutaka Ban et al.

It is certified that error appears in the above-identified patent and that said Letters Patent is hereby corrected as shown below:

Column 15,
Line 14, "blanching" should read -- branching --;
Line 16, "integral" should read -- integrally --; and
Line 19, "irrespective" should read -- irrespectively --.

Signed and Sealed this

Tenth Day of May, 2005

JON W. DUDAS
*Director of the United States Patent and Trademark Office*